US008918029B2

(12) United States Patent
Matsumoto

(10) Patent No.: US 8,918,029 B2
(45) Date of Patent: Dec. 23, 2014

(54) DEVELOPER CONTAINER AND IMAGE-FORMING APPARATUS

(75) Inventor: Takuji Matsumoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 244 days.

(21) Appl. No.: 13/398,510

(22) Filed: Feb. 16, 2012

(65) Prior Publication Data

US 2013/0078004 A1 Mar. 28, 2013

(30) Foreign Application Priority Data

Sep. 22, 2011 (JP) ..... 2011-207788

(51) Int. Cl.
*G03G 15/08* (2006.01)

(52) U.S. Cl.
CPC ..... *G03G 15/0886* (2013.01)
USPC ..... 399/260; 399/262; 399/258

(58) Field of Classification Search
USPC ..... 399/262, 260, 119, 258, 281, 112
See application file for complete search history.

(56) References Cited

U.S. PATENT DOCUMENTS

| | | | | |
|---|---|---|---|---|
| 2007/0212118 | A1 | 9/2007 | Nagae et al. | |
| 2009/0129826 | A1 | 5/2009 | Koshimori et al. | |
| 2010/0129118 | A1 * | 5/2010 | Kimura et al. | 399/260 |

FOREIGN PATENT DOCUMENTS

| | | | |
|---|---|---|---|
| AU | 2007201469 | A1 | 4/2008 |
| JP | 2006-139074 | A | 6/2006 |
| JP | 2006-309147 | A | 11/2006 |
| JP | 2008-083549 | A | 4/2008 |
| JP | 2009-122546 | A | 6/2009 |

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

A developer container includes a container body having an inner space capable of containing a developer and an opening communicating with the inner space; an opening and closing portion that is disposed on the container body and that opens and closes the opening; and a pair of restraining portions that are disposed on the opening and closing portion and that each restrain the opening and closing portion from being moved from a closed position to an open position. The opening and closing portion is permitted to be moved to the open position if the restraint on the movement of the opening and closing portion by each of the pair of restraining portions is independently removed.

10 Claims, 16 Drawing Sheets

DEVELOPER CONTAINER AND IMAGE-FORMING APPARATUS

CROSS-REFERENCE TO RELATED APPLICATIONS

This application is based on and claims priority under 35 USC 119 from Japanese Patent Application No. 2011-207788 filed Sep. 22, 2011.

BACKGROUND

(i) Technical Field

The present invention relates to developer containers and image-forming apparatuses.

SUMMARY

According to an aspect of the invention, there is provided a developer container including a container body having an inner space capable of containing a developer and an opening communicating with the inner space; an opening and closing portion that is disposed on the container body and that opens and closes the opening; and a pair of restraining portions that are disposed on the opening and closing portion and that each restrain the opening and closing portion from being moved from a closed position to an open position. The opening and closing portion is permitted to be moved to the open position if the restraint on the movement of the opening and closing portion by each of the pair of restraining portions is independently removed.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will now be described with reference to the drawings.

Structure of Image-Forming Apparatus 10 According to Exemplary Embodiment

Figure 1:
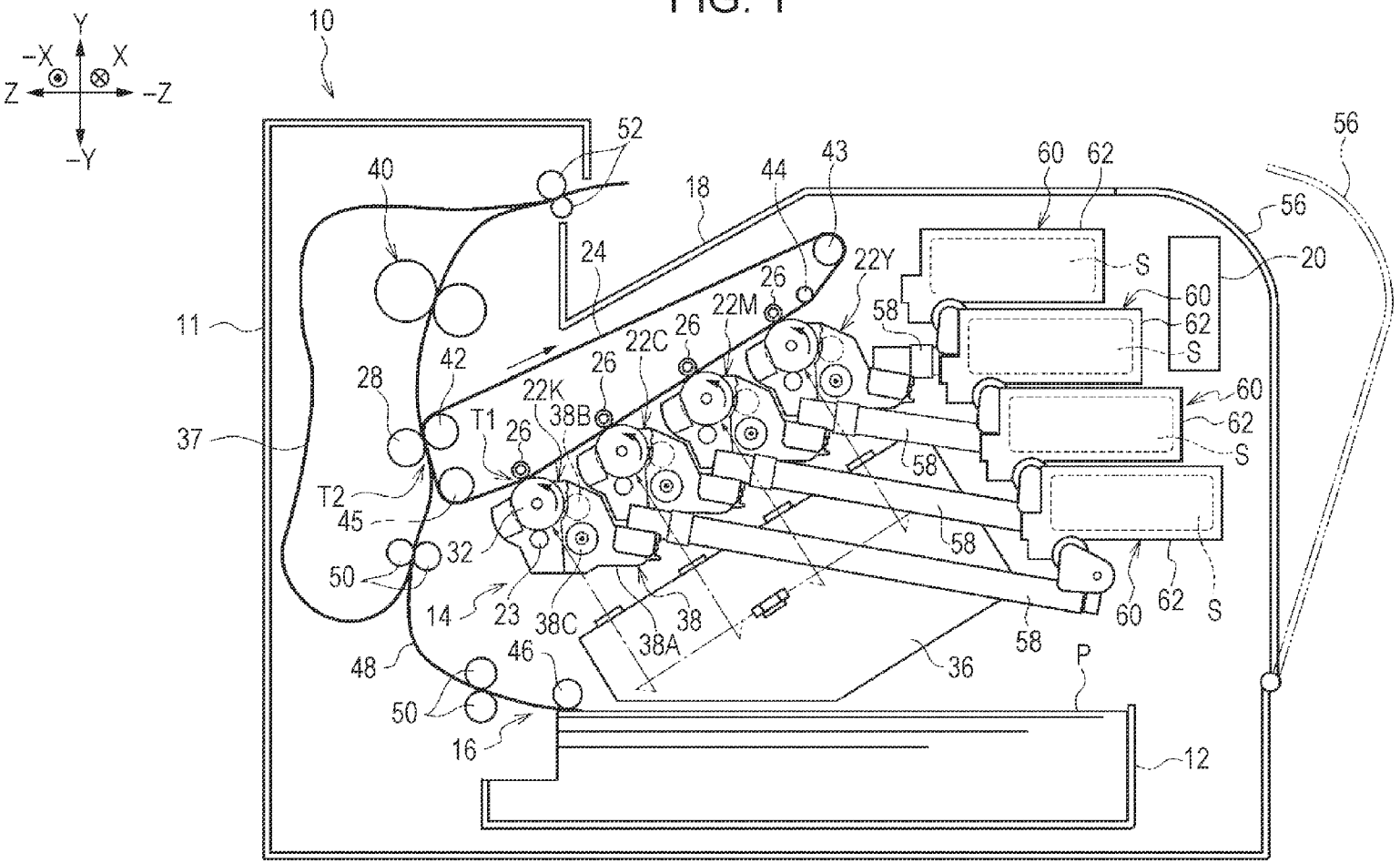
FIG. 1 is a schematic view showing the structure of an image-forming apparatus according to an exemplary embodiment of the invention.

First, the structure of an image-forming apparatus 10 according to this exemplary embodiment will be described. FIG. 1 is a schematic view showing the structure of the image-forming apparatus 10 according to this exemplary embodiment. In the following description, the X direction, the −X direction, the Y direction (upward), the −Y direction (downward), the Z direction, and the −Z direction are indicated by the arrows in the drawings. In the drawings, the circled times indicates an arrow pointing into the page, and the circled dot indicates an arrow pointing out of the page.

As shown in FIG. 1, the image-forming apparatus 10 has an image-forming apparatus body 11 including various components. Housed in the image-forming apparatus body 11 are a container section 12 that contains a recording medium P such as paper, an image-forming section 14 that forms an image on the recording medium P, a transport section 16 that transports the recording medium P from the container section 12 to the image-forming section 14, and a controller 20 that controls the operation of various components of the image-forming apparatus 10. In addition, an eject section 18 to which the recording medium P having the image formed by the image-forming section 14 is ejected is disposed at the top of the image-forming apparatus body 11.

The image-forming section 14 includes image-forming units 22Y, 22M, 22C, and 22K (hereinafter referred to as "22Y to 22K") that form yellow (Y), magenta (M), cyan (C), and black (K) toner images, respectively; an intermediate transfer belt 24 onto which the toner images are transferred from the image-forming units 22Y to 22K; first transfer rollers 26 that transfer the toner images from the image-forming units 22Y to 22K onto the intermediate transfer belt 24; and a second transfer roller 28 that transfers the toner images from the intermediate transfer belt 24 onto the recording medium P. The structure of the image-forming section 14 is not limited to the example shown above; it may have any other structure that forms an image on the recording medium P.

The image-forming units 22Y to 22K are arranged in a direction inclined with respect to the horizontal direction (Z or −Z direction) in the image-forming apparatus body 11. The image-forming units 22Y to 22K each include a photoreceptor 32 that rotates in one direction (for example, counterclockwise in FIG. 1). In FIG. 1, the components of the image-forming units 22Y, 22M, and 22C are not indicated by reference numerals because they are similarly configured.

The photoreceptors 32 are each surrounded by, in order from the upstream side in the rotational direction of the photoreceptor 32, a charging roller 23, as an example of a charging device, that charges the photoreceptor 32; and a developing device 38 that develops an electrostatic latent image formed on the photoreceptor 32 charged by the charging roller 23 through exposure by an exposure device 36, described later, to form a toner image.

The exposure device 36, which exposes the photoreceptors 32 charged by the charging rollers 23 to form electrostatic latent images on the photoreceptors 32, is disposed to the lower right of the image-forming units 22Y to 22K in FIG. 1. The exposure device 36 forms electrostatic latent images on the basis of an image signal received from the controller 20. An example of an image signal received from the controller 20 is an image signal acquired from an external device by the controller 20.

The developing devices 38 each include a housing 38A containing a developer containing a toner, a developer supply member 38B that is supported by the housing 38A and that supplies the developer to the photoreceptor 32, and a transport member 38C that transports the developer to the developer supply member 38B while stirring it.

The intermediate transfer belt 24, which is ring-shaped, is disposed above the image-forming units 22Y to 22K (on the Y direction side). Tension rollers 42 to 45 are disposed inside the intermediate transfer belt 24, which is stretched around the tension rollers 42 to 45. The intermediate transfer belt 24 is circulated (rotated) in one direction (for example, clockwise in FIG. 1) in contact with the photoreceptors 32 as one of the tension rollers 42 to 45 rotates. The tension roller 42 is disposed opposite the second transfer roller 28.

The first transfer rollers 26 are disposed opposite the photoreceptors 32 with the intermediate transfer belt 24 therebetween. The toner images formed on the photoreceptors 32 are transferred onto the intermediate transfer belt 24 at first transfer positions T1 between the first transfer rollers 26 and the photoreceptors 32.

The second transfer roller 28 is disposed opposite the tension roller 42 with the intermediate transfer belt 24 therebetween. The toner images are transferred from the intermediate transfer belt 24 onto the recording medium P at a second transfer position T2 between the second transfer roller 28 and the tension roller 42.

The transport section 16 includes a feed roller 46 that feeds the recording medium P from the container section 12, a transport path 48 on which the recording medium P fed by the feed roller 46 is transported, and transport rollers 50 that are arranged along the transport path 48 and that transport the recording medium P fed by the feed roller 46 to the second transfer position T2.

A fixing device 40 that fixes the toner image formed on the recording medium P by the image-forming section 14 is disposed downstream of the second transfer position T2 in the transport direction. Eject rollers 52 that eject the recording medium P having the toner image fixed thereon to the eject section 18 are disposed downstream of the fixing device 40 in the transport direction.

A reverse transport path 37 on which the recording medium P having the toner image fixed on one side is reversed and transported back to the second transfer position T2 is provided on the side of the transport path 48 facing away from the intermediate transfer belt 24 (on the Z direction side). To form images on both sides of the recording medium P, the recording medium P having the toner image fixed on one side is switched back by the eject rollers 52 and is transported back to the second transfer position T2 on the reverse transport path 37.

Disposed on the −Z direction side of the image-forming apparatus body 11 are developer containers (toner cartridges) 60 that contain developers of the individual colors, transport tubes 58 through which the developers discharged from the developer containers 60 are transported to the developing devices 38, and an opening and closing portion 56 that can be opened and closed relative to the image-forming apparatus body 11. The developer containers 60 are arranged in the vertical direction (Y direction).

Figure 2:
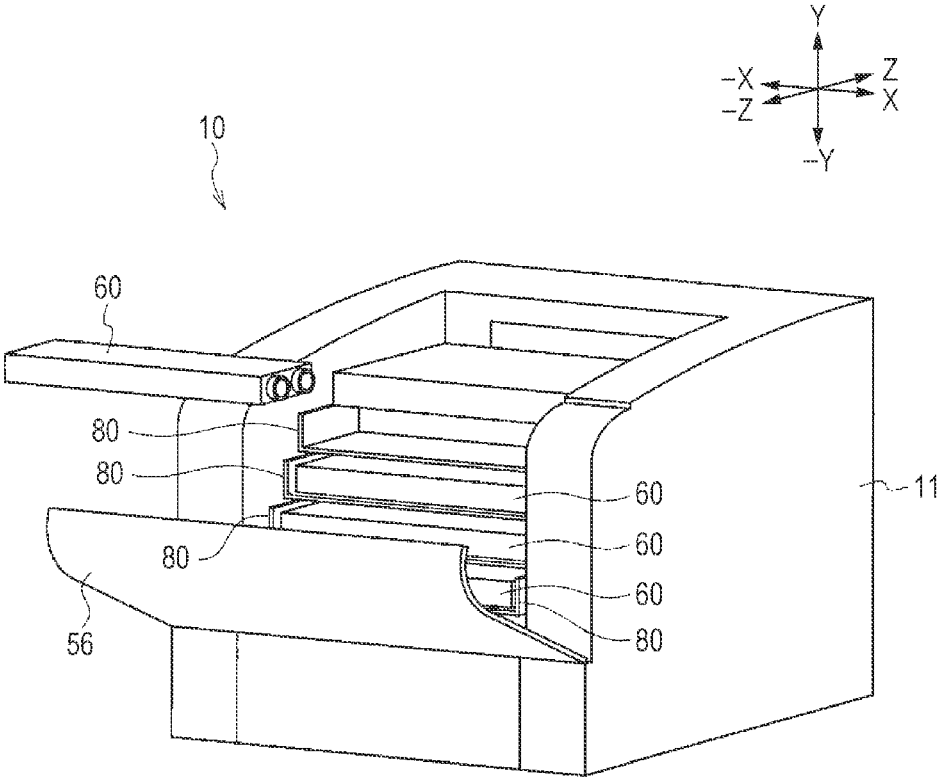
FIG. 2 is a perspective view showing how a developer container according to the exemplary embodiment is attached to and detached from a mounting on an image-forming apparatus body.

Specifically, as shown in FIG. 2, with the opening and closing portion 56 open relative to the image-forming apparatus body 11, the developer containers 60 are detachable from mountings 80 disposed on the image-forming apparatus body 11 in a predetermined detachment direction (−Z direction) and are attachable thereto in a predetermined attachment direction (Z direction). The specific structures of the developer containers 60 and the mountings 80 are described later.

Next, the image-forming operation by which an image is formed on the recording medium P in the image-forming apparatus 10 according to this exemplary embodiment will be described.

In the image-forming apparatus 10 according to this exemplary embodiment, the recording medium P fed from the container section 12 by the feed roller 46 is transported to the second transfer position T2 by the transport rollers 50.

In the image-forming units 22Y to 22K, the photoreceptors 32 charged by the charging rollers 23 are exposed by the exposure device 36 to form electrostatic latent images on the photoreceptors 32. The electrostatic latent images are developed by the developing devices 38 to form toner images on the photoreceptors 32. The toner images of different colors formed by the image-forming units 22Y to 22K are superimposed on the intermediate transfer belt 24 at the first transfer positions T1 to form a color image. The color image is then transferred from the intermediate transfer belt 24 onto the recording medium P at the second transfer position T2.

The recording medium P having the toner image is transported to the fixing device 40, which fixes the toner image. If an image is formed on only one side of the recording medium P, after the toner image is fixed, the recording medium P is ejected to the eject section 18 by the eject rollers 52.

If images are formed on both sides of the recording medium P, after an image is formed on one side, the recording medium P is switched back by the eject rollers 52 and is reversed and transported to the reverse transport path 37. The recording medium P is then transported on the reverse transport path 37 back to the second transfer position T2, at which an image is similarly formed on the other side, on which no image is recorded. The recording medium P having the images formed on both sides is ejected to the eject section 18 by the eject rollers 52. In this way, the image-forming operation is performed.

Specific Structure of Developer Containers 60

Next, the specific structure of the developer containers 60 will be described.

Figure 3:
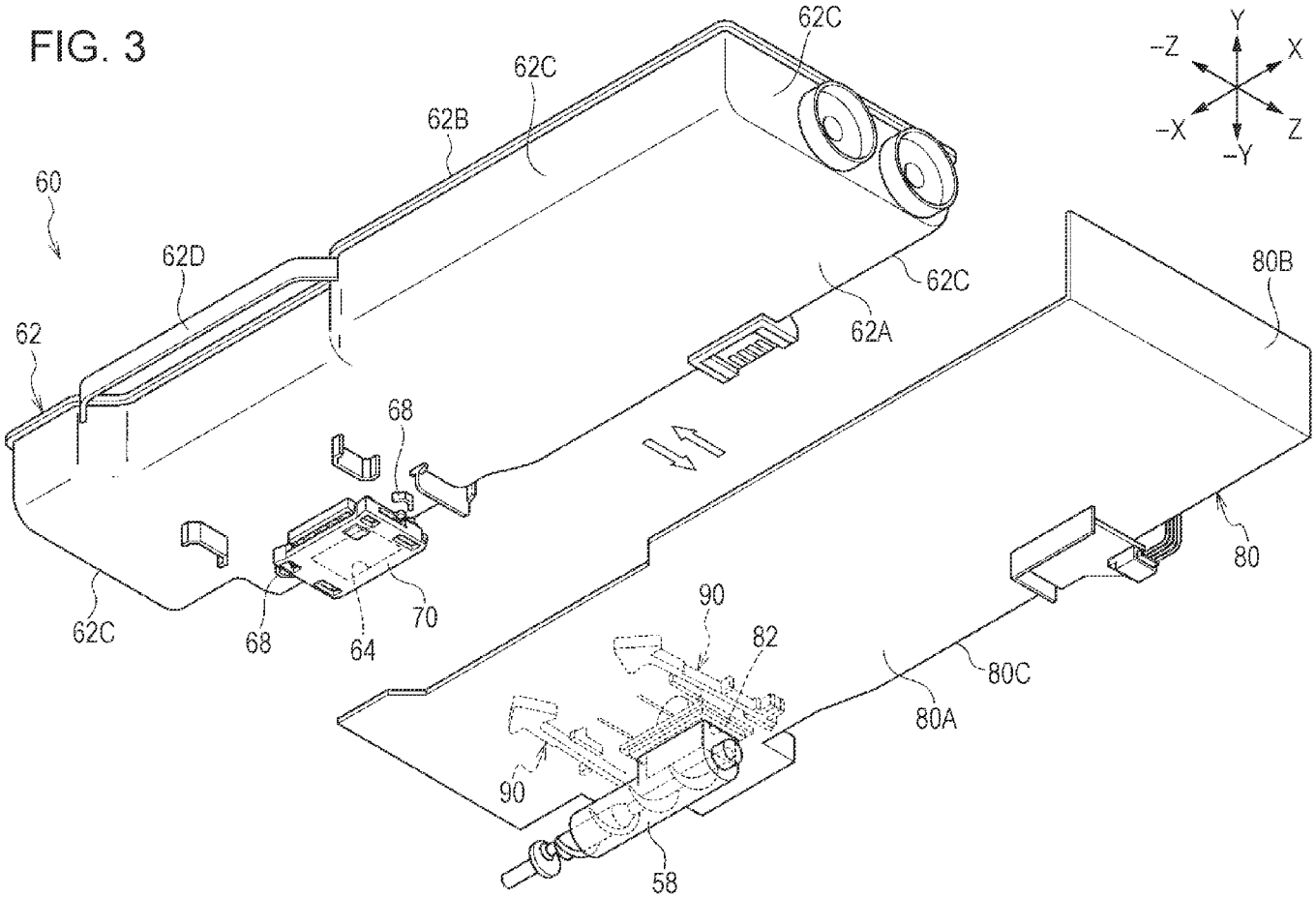
FIG. 3 is a perspective view showing the structures of the developer container and the mounting according to the exemplary embodiment.

Referring to FIG. 3, the developer containers 60 each include a container body 62 having an inner space S (see FIG. 1) capable of containing a developer and an opening 64 communicating with the inner space S; and a shutter 70, as an example of an opening and closing portion, that is disposed on the container body 62 and that opens and closes the opening 64.

The container body 62 is a substantially rectangular box (housing) that has its length in the X direction. The box forming the container body 62 includes a bottom wall 62A, a top wall 62B, and four side walls 62C. A handle 62D for an operator to grip when attaching or detaching the developer container 60 to or from the mounting 80 is disposed on the side wall 62C of the container body 62 on the −Z direction side.

Figure 4:
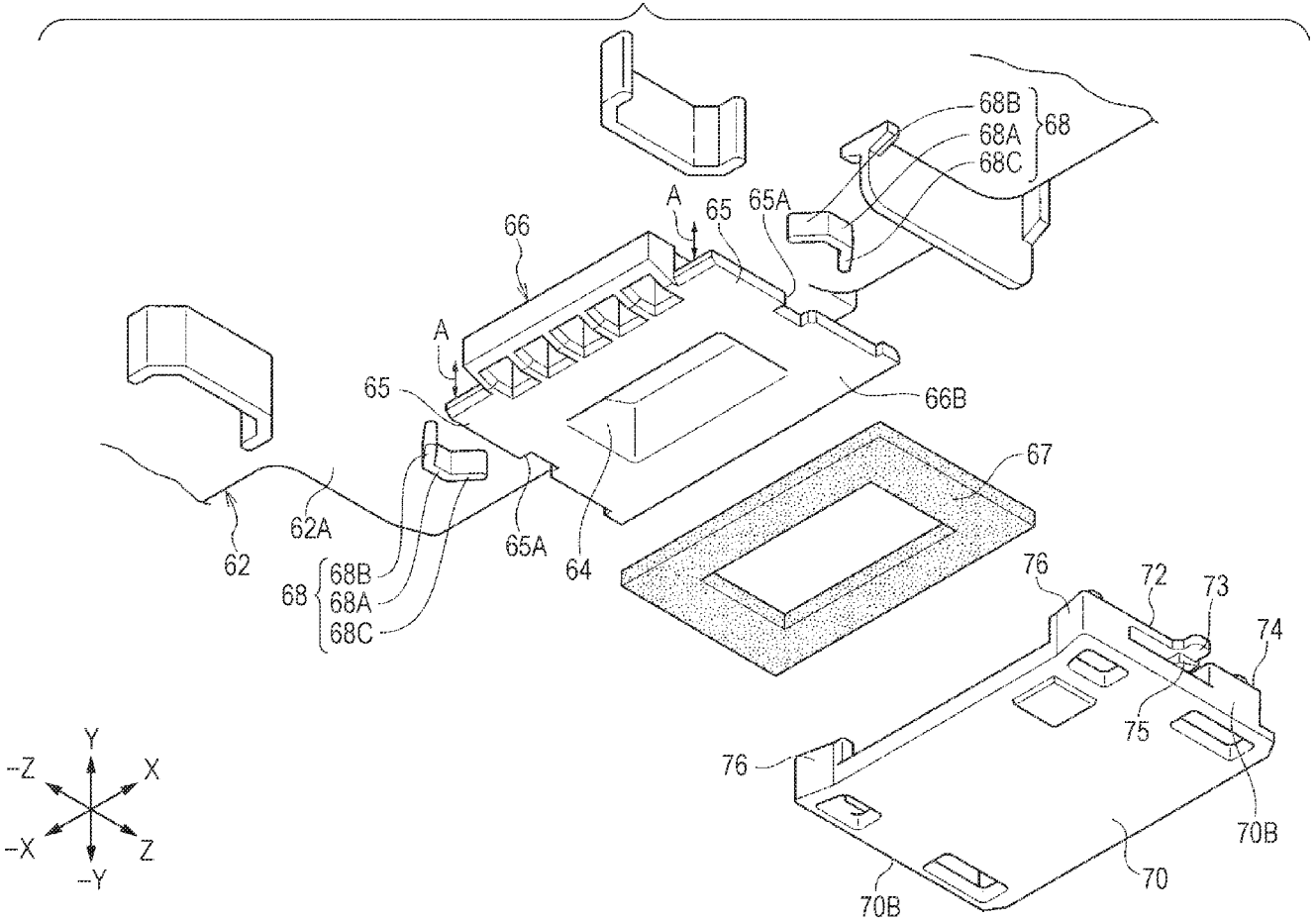
FIG. 4 is a perspective view showing the structure of the periphery of an opening in the developer container according to the exemplary embodiment.

The opening 64 is provided in the bottom wall 62A of the container body 62 on the −X direction side with respect to the center in the X direction. As shown in FIG. 4, a support 66 that supports the shutter 70 is disposed on the container body 62 so as to surround the opening 64.

The support 66 includes support portions 65, as overhanging portions, that extend away from the opening 64 in the X or −X direction and that have their length in the Z direction. The support portions 65 have clearances A in which supported portions 74, described later, of the shutter 70 can be inserted between the support portions 65 and the bottom wall 62A of the container body 62.

Figure 6:
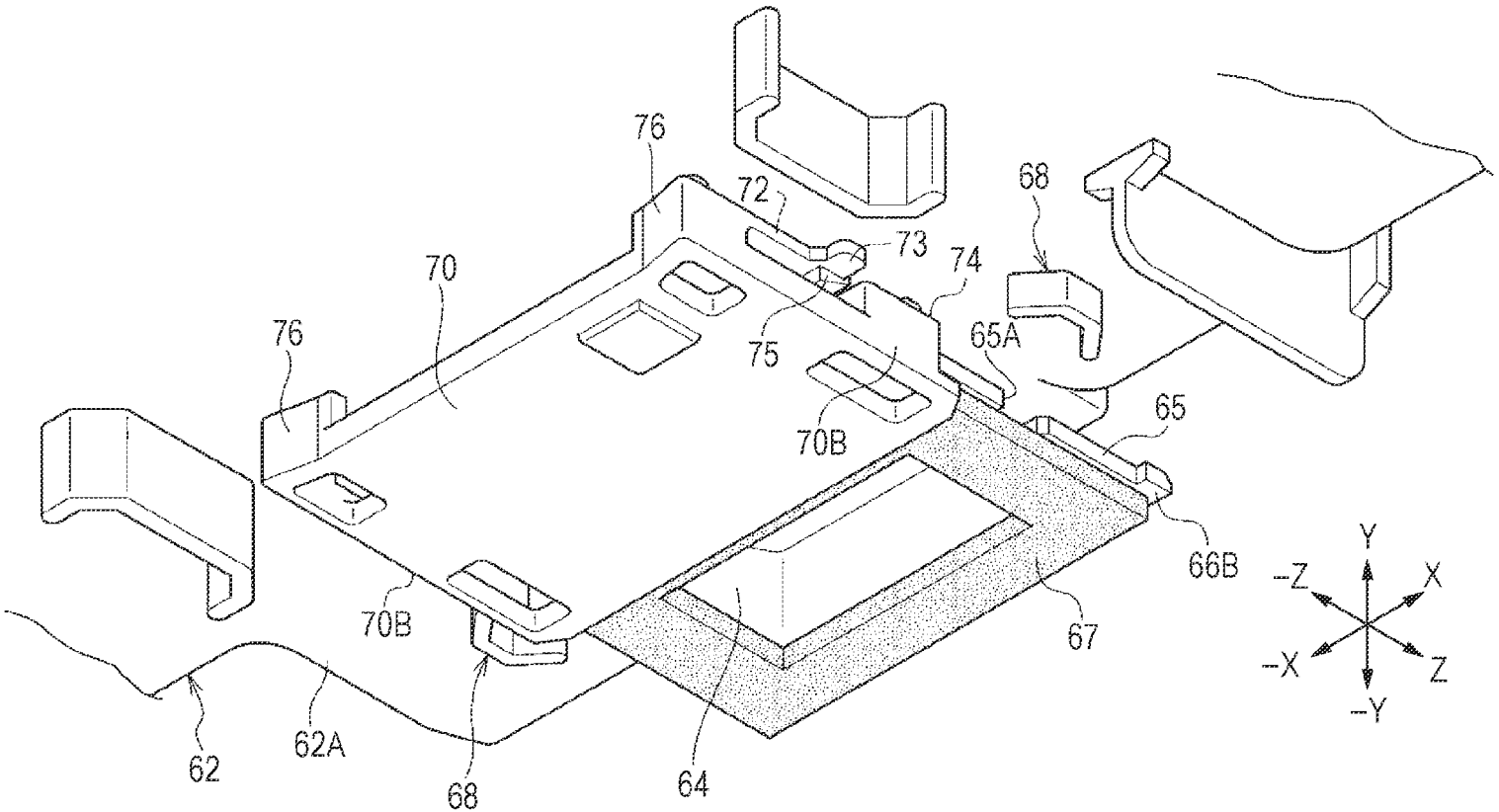
FIG. 6 is a perspective view showing the state where the shutter according to the exemplary embodiment is in an open position for opening the opening.

The support portions 65 have latch cutouts 65A at the center in the longitudinal direction thereof (Z direction). As shown in FIGS. 4 and 6, additionally, a seal 67 is disposed on the bottom surface 66B (around the opening 64) of the support 66, including the support portions 65, to seal the gap between the bottom surface 66B and the shutter 70.

Figure 5:
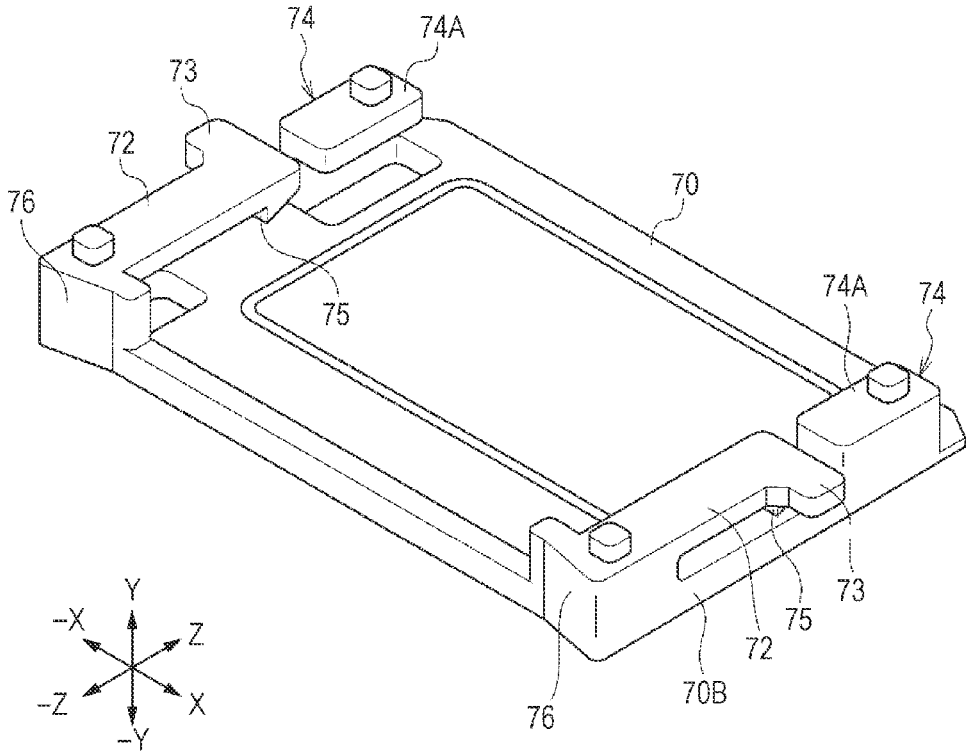
FIG. 5 is a perspective view showing the structure of a shutter according to the exemplary embodiment.

As shown in FIG. 5, the shutter 70 is formed of a plate that covers the opening 64. The plate forming the shutter 70 has its thickness in the vertical direction (Y or −Y direction).

The shutter 70 includes the supported portions 74, supported by the support portions 65 of the support 66, on the Z direction side, one on the −X direction side and the other on the X direction side. The supported portions 74 are raised from the shutter 70 in the Y direction and have ends 74A thereof bent in the X direction (the supported portion 74 on the −X direction side) or in the −X direction (the supported portion 74 on the X direction side), being L-shaped as viewed in the −Z direction.

The shutter 70 is attached to the container body 62 by inserting the ends 74A of the supported portions 74 into the clearances A between the bottom wall 62A of the container body 62 and the support portions 65 and inserting the support portions 65 between the ends 74A of the supported portions 74 and the shutter 70. In this way, the shutter 70 is supported so as to be movable along the surface of the bottom wall 62A of the container body 62 in the longitudinal direction of the support portions 65 (Z or −Z direction). Specifically, the shutter 70 is supported so as to be linearly movable between an open position (see FIG. 6) for opening the opening 64 and a closed position (see FIG. 3) for closing the opening 64 along the surface of the bottom wall 62A of the container body 62 in the longitudinal direction of the support portions 65 (Z or −Z direction). The direction in which the shutter 70 is moved is the same as the direction in which the developer container 60 is attached to and detached from the mounting 80.

As shown in FIG. 5, the shutter 70 includes stop portions 76 on the −Z direction side that stop the movement of the shutter 70 in the Z direction, one on the −X direction side and the other on the X direction side. The stop portions 76 abut against the ends of the support portions 65 on the −Z direction side to stop the shutter 70 from being moved beyond the closed position for closing the opening 64 to the side facing away from the open position (in the Z direction).

Figure 7:
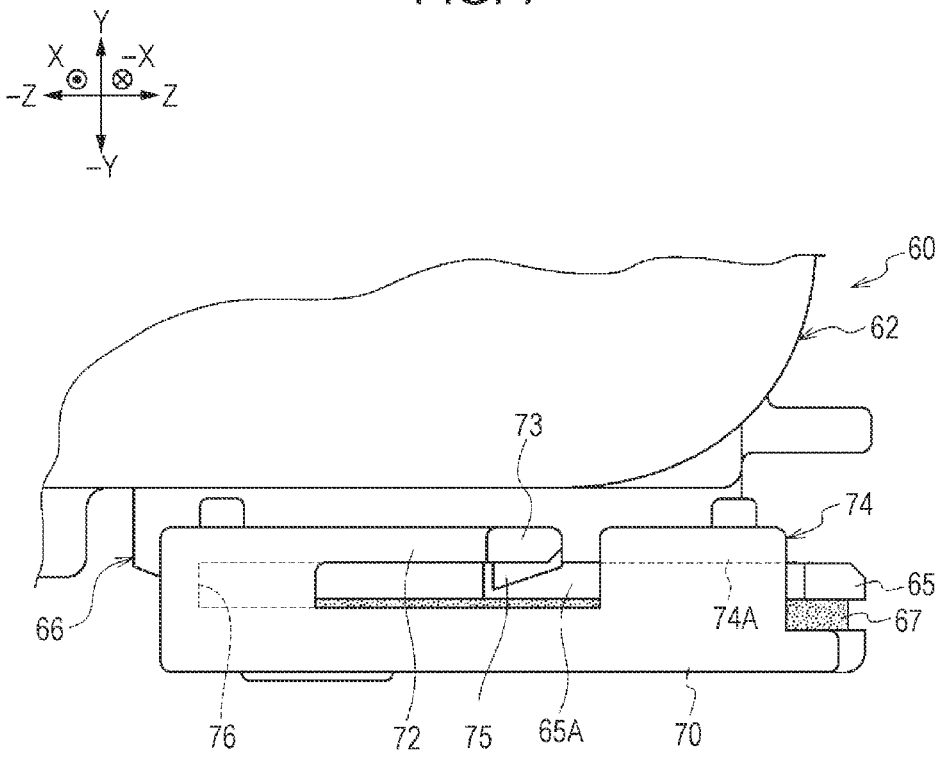
FIG. 7 is a side view showing the state where the shutter according to the exemplary embodiment is in a closed position for closing the opening.

As shown in FIGS. 5 and 7, the shutter 70 includes latch portions 75, as an example of restraining portions, that are disposed between the stop portions 76 and the supported portions 74 on the −X and X direction sides and that restrain the shutter 70 from being moved from the closed position to the open position. Specifically, the latch portions 75 are catches facing downward (in the −Y direction). The catches forming the latch portions 75 are latched in the cutouts 65A of the support 66.

The latch portions 75 are supported by support portions 72 cantilevered from the stop portions 76 in the Z direction and are located at the center of the shutter 70 in the direction in which the shutter 70 is moved (the direction in which the shutter 70 is linearly moved). As shown in FIG. 7, the latch portions 75 are located between the supported portions 74 and the stop portions 76 as viewed in the −X direction and between the container body 62 and the shutter 70.

The shutter 70 also includes protruding portions 73 that protrude in the −X direction (the protruding portion 73 on the −X direction side) or in the X direction (the protruding portion 73 on the X direction side) and that are integrally formed with the latch portions 75. The protruding portions 73 protrude farther in the −X direction (the protruding portion 73 on the −X direction side) or in the X direction (the protruding portion 73 on the X direction side) than the sides 70B of the shutter 70. The supported portions 74, the latch portions 75, the support portions 72, and the stop portions 76 are located closer to the center of the shutter 70 in the X direction than the sides 70B of the shutter 70.

With the latch portions 75 latched in the cutouts 65A, the protruding portions 73 are pushed upward (in the Y direction) to elastically deform the support portions 72 so that the latch portions 75 come out of the cutouts 65A upward (in the Y direction). That is, the restraint on the movement of the shutter 70 by the latch portions 75 is removed as the latch portions 75 are moved in a direction toward the container body 62 and different from (specifically, perpendicular to) the direction in which the shutter 70 is opened and closed. In this exemplary embodiment, the direction toward the container body 62 is the Y direction.

The latch portions 75, which are not operatively associated with each other, each independently restrain the shutter 70 from being moved, and the restraint on the movement of the shutter 70 by each of the latch portions 75 is independently removed. The latch portions 75 have the respective protruding portions 73, as manipulation portions, so that they can be independently manipulated. Accordingly, each of the pair of latch portions 75, which can be independently manipulated, is manipulated to remove the restraint on the movement of the shutter 70 by each of the pair of latch portions 75, thus permitting the movement of the shutter 70 to the open position.

As described above, the shutter 70 includes the pair of supported portions 74, the pair of stop portions 76, the pair of latch portions 75, the pair of support portions 72, and the pair of protruding portions 73.

As shown in FIGS. 3 and 4, the container body 62 includes protective portions 68 that protect the latch portions 75 when the shutter 70 is in the closed position. Specifically, the protective portions 68 are disposed on both sides of the shutter 70. That is, one of the protective portions 68 is disposed on the −X direction side of the cutout 65A located on the −X direction side of the opening 64, while the other protective portion 68 is disposed on the X direction side of the cutout 65A located on the X direction side of the opening 64. Thus, the protective portions 68 have the function of making the latch portions 75 and the protruding portions 73 less accessible from outside when the shutter 70 is in the closed position.

As shown in FIG. 4, the protective portions 68 each include a first rib 68A extending in the Z direction, a second rib 68B inclined toward the cutout 65A (in the X or −X direction) as it extends from the end of the first rib 68A in the −Z direction, and a third rib 68C inclined toward the cutout 65A (in the X or −X direction) as it extends from the end of the first rib 68A in the Z direction. The distance between the ends of the second rib 68B and the third rib 68C facing the cutout 65A (the ends on the X or −X direction side) in the Z direction is larger than the width of the cutout 65A in the Z direction.

Specific Structure of Mountings 80

Next, the specific structure of the mountings 80 will be described.

Figure 8:
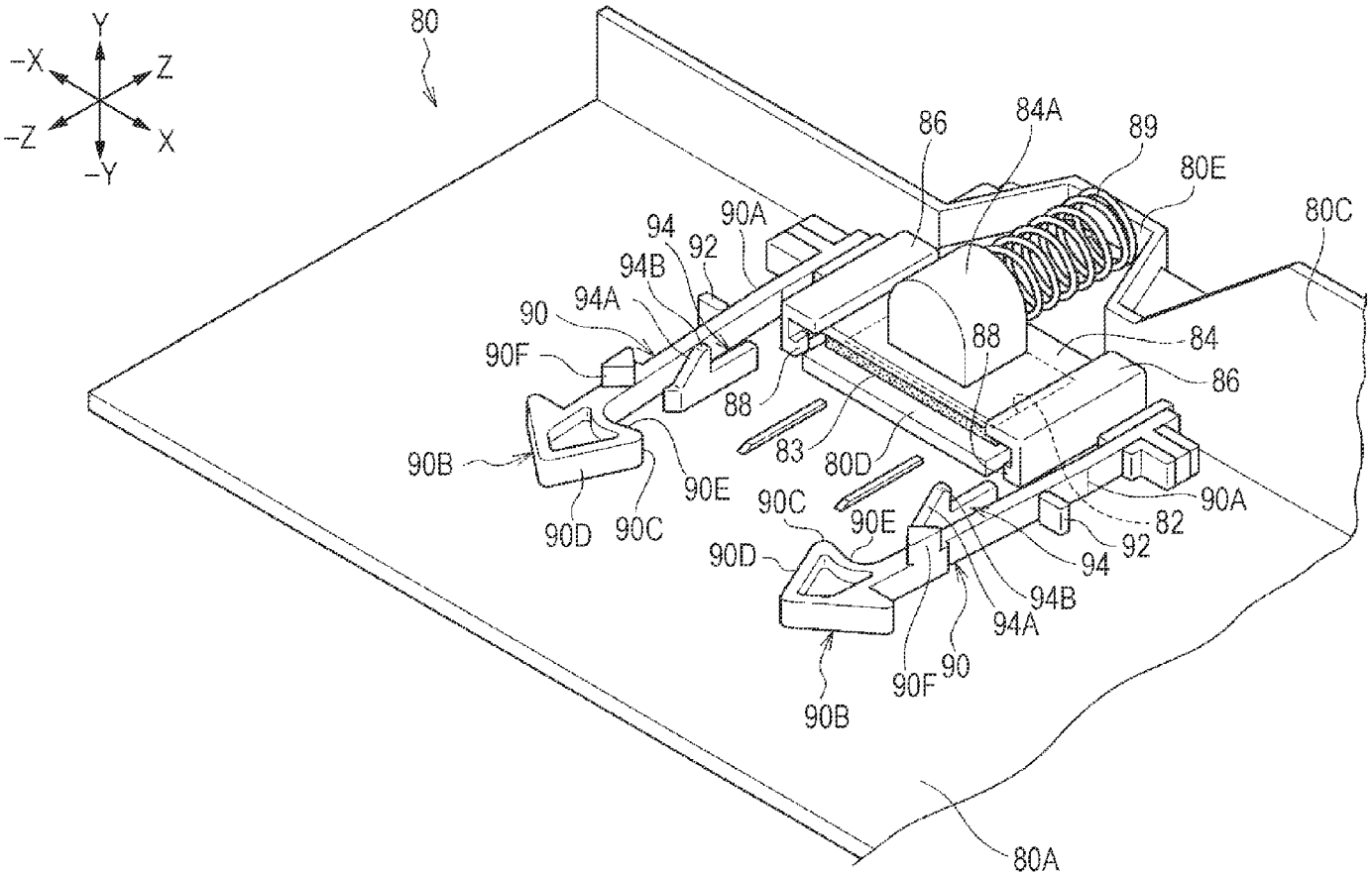
FIG. 8 is a perspective view showing the structure of the periphery of an inlet in the developer container according to the exemplary embodiment.

Referring to FIG. 3, the mountings 80, to which the developer containers 60 are attached, each include a bottom plate 80A, a side plate 80B disposed at the end of the bottom plate 80A in the X direction, and a side plate 80C disposed at the end of the bottom plate 80A in the Z direction. As shown in FIG. 8, the bottom plate 80A includes a thick portion 80D on the −X direction side. The thick portion 80D has its thickness in the vertical direction (Y direction) and is rectangular as viewed in the −Y direction. The side plate 80C includes a receiving portion 80E that is U-shaped in the −Z direction and that receives an axial end of a compression spring 89, described later.

The mounting 80 has an inlet 82 into which the developer discharged from the opening 64 of the developer container 60 flows, an opening and closing portion 84 that opens and closes the inlet 82, and support portions 86 that support the opening and closing portion 84 so as to be movable in the −Z or Z direction.

Specifically, the inlet 82 is provided in the thick portion 80D and is located opposite the opening 64 of the developer container 60 when the developer container 60 is attached to the mounting 80.

The opening and closing portion 84 is plate-shaped with its thickness in the vertical direction (Y direction). A seal 83 is disposed on the surface of the opening and closing portion 84 opposite the inlet 82 (the surface on the −Y direction side) to seal the gap between the edge of the inlet 82 and the opening and closing portion 84.

The support portions 86 are disposed on the −X and X direction sides of the opening and closing portion 84. The support portions 86 are raised from the bottom plate 80A of the mounting 80 in the Y direction and have the ends thereof bent in the X direction (the support portion 86 on the −X direction) or in the −X direction (the support portion 86 on the X direction), being L-shaped as viewed in the −Z direction. The support portions 86 support the opening and closing portion 84 such that the −X and X direction sides of the opening and closing portion 84 are held between the support portions 86 on the −X and X direction sides, respectively, and the bottom plate 80A of the mounting 80 in the thickness direction.

In this way, the pair of support portions 86 support the opening and closing portion 84 so as to be movable between an open position for opening the inlet 82 (see FIG. 15) and a closed position for closing the inlet 82 (see FIGS. 8 and 9) in the longitudinal direction of the support portions 86 (Z direction).

Stop portions 88 that stop the movement of the opening and closing portion 84 in the −Z direction are disposed on the −Z direction sides of the support portions 86. The stop portions 88 abut against the end of the opening and closing portion 84 on the −Z direction side to stop the opening and closing portion 84 from being moved beyond the closed position for closing the inlet 82 to the side facing away from the open position (in the −Z direction).

The opening and closing portion 84 has the compression spring 89, as a biasing member, which biases the opening and closing portion 84 to the closed position for closing the inlet 82. The compression spring 89 has one axial end thereof in contact with the receiving portion 80E of the side plate 80C of the mounting 80 and has the other axial end thereof fixed to a mounting portion 84A disposed on the opening and closing portion 84.

Limiting portions 90 are disposed on the bottom plate 80A of the mounting 80. With the developer container 60 attached to the mounting 80, the limiting portions 90 limit the movement of the shutter 70 moved to the open position for opening the opening 64 of the container body 62 beyond the open position to the side facing away from the closed position (−Z direction). The limiting portions 90 have their length in the Z direction and are provided as a pair on the X and −X direction sides, with the opening and closing portion 84 and the support portions 86 therebetween.

As used hereinafter, the terms "inside" and "inward" for the limiting portions 90 refer to the −X direction side of the limiting portion 90 disposed on the X direction side and the X direction side of the limiting portion 90 disposed on the −X direction side. In addition, the terms "outside" and "outward" for the limiting portions 90 refer to the X direction side of the limiting portion 90 disposed on the X direction side and the −X direction side of the limiting portion 90 disposed on the −X direction side.

The base ends of the limiting portions 90 (the ends on the Z direction side) are fixed to the bottom plate 80A of the mounting 80. The longitudinally middle portions 90A and the leading ends 90B (the portions on the −Z direction side) of the limiting portions 90 are not fixed to the bottom plate 80A of the mounting 80 and are movable in the −X or X direction as the longitudinally middle portions 90A are elastically deformed.

The limiting portions 90 are hook-shaped with the leading ends 90B curved inward. The leading ends 90B have protrusions 90C having rounded ends, inclined surfaces 90D facing the −Z direction and inclined inward as they extend in the Z direction, and inclined surfaces 90E facing the Z direction and inclined to the −Z direction as they extend outward.

Figure 9:
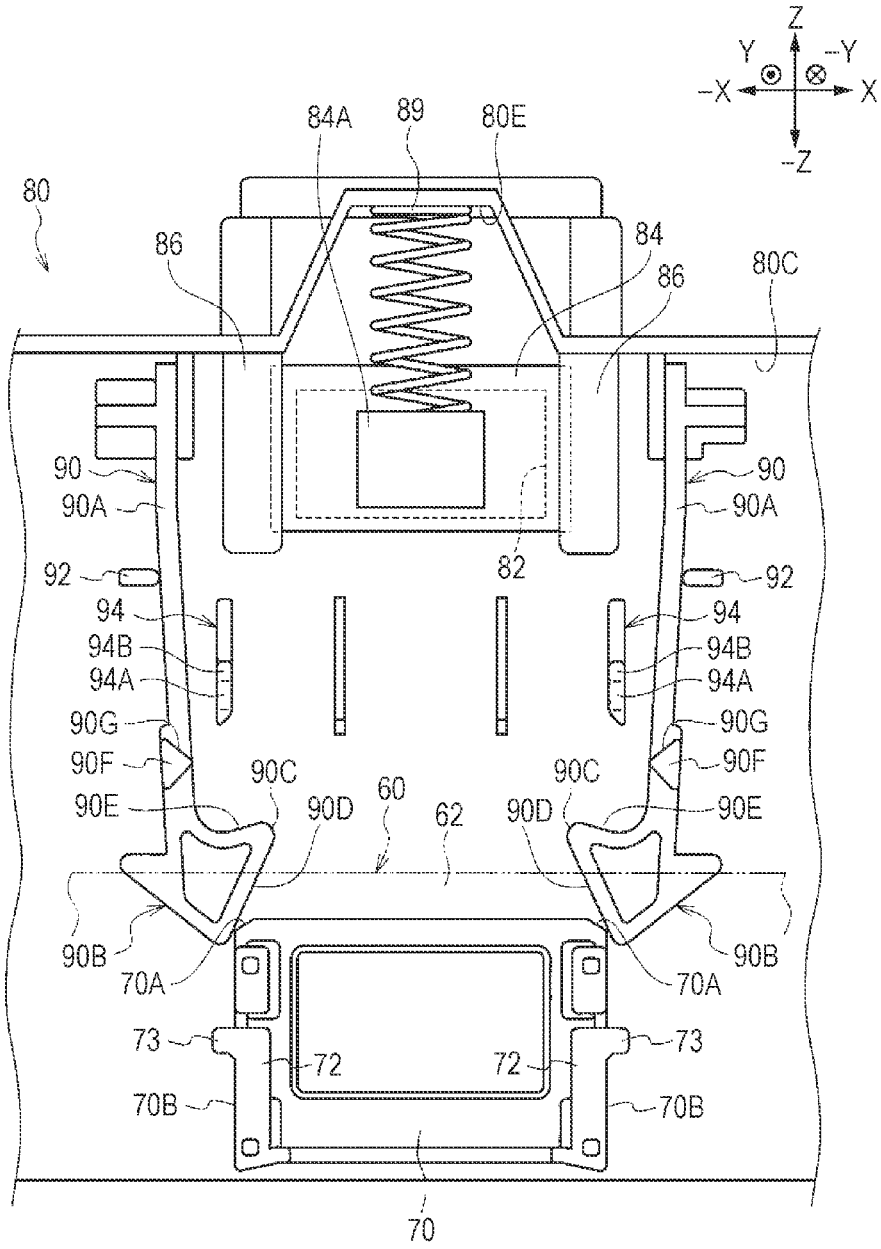
FIG. 9 illustrates how the developer container according to the exemplary embodiment is attached to the mounting.

The distance between the inclined surfaces 90D of the pair of limiting portions 90 in the X direction is set such that, when the developer container 60 is attached to the mounting 80, the corners 70A of the shutter 70 on the attachment direction side (Z direction side), one on the X direction side and the other on the −X direction side, abut against the inclined surfaces 90D of the limiting portions (see FIG. 9).

The distance between the portions extending from the leading ends 90B to the base ends (the portions on the Z direction side) of the pair of limiting portions 90 in the X direction is larger than the width of the shutter 70 in the X direction. The distance between the protrusions 90C of the pair of limiting portions 90 in the X direction is smaller than the width of the shutter 70 in the X direction (see FIG. 11).

Triangular portions 90F are disposed on the top surfaces of the limiting portions 90 (the surfaces on the Y direction side) between the longitudinally middle portions 90A and the leading ends 90B, with the vertices thereof facing inward in plan view (as viewed in the Y direction). The positions of the triangular portions 90F relative to the pair of limiting portions 90 are set such that, when the developer container 60 is detached from the mounting 80, the third ribs 68C of the protective portions 68 abut against inclined surfaces 90G of the triangular portions 90F on the Z direction side to push the pair of limiting portions 90 outward (see FIG. 16).

Stop portions 92 that stop the longitudinally middle portions 90A and the leading ends 90B (the portions on the −Z direction side) of the limiting portions 90 from being moved outward are disposed outside the limiting portions 90 on the bottom plate 80A of the mounting 80.

A pair of release portions 94 that independently release the pair of latch portions 75 as the developer container 60 is attached to the mounting 80 are disposed inside the limiting portions 90 on the bottom plate 80A of the mounting 80 between the stop portions 92 and the triangular portions 90F in the Z direction. The pair of release portions 94 have lifting surfaces 94A that lift the protruding portions 73 in the Y direction as the developer container 60 is attached to the mounting 80. The pair of release portions 94 have top surfaces 94B on the Z direction side of the lifting surfaces 94A. The lifting surfaces 94A slope upward in the Y direction as they extend in the Z direction. The top surfaces 94B are horizontal or slope upward more gently than the lifting surfaces 94A.

Operation According to Exemplary Embodiment

Next, the operation according to this exemplary embodiment will be described.

As shown in FIG. 3, upon starting of the attachment of the developer container 60 to the mounting 80 in the attachment direction (Z direction), as shown in FIG. 9, the corners 70A on the X and −X direction sides of the shutter 70 on the attachment direction side (Z direction side) abut against the inclined surfaces 90D of the leading ends 90B of the limiting portions 90.

As the developer container 60 is further moved relative to the mounting 80 in the attachment direction (Z direction), the corners 70A of the shutter 70 push the leading ends 90B of the limiting portions 90 outward to elastically deform the pair of limiting portions 90 outward.

Figure 10:
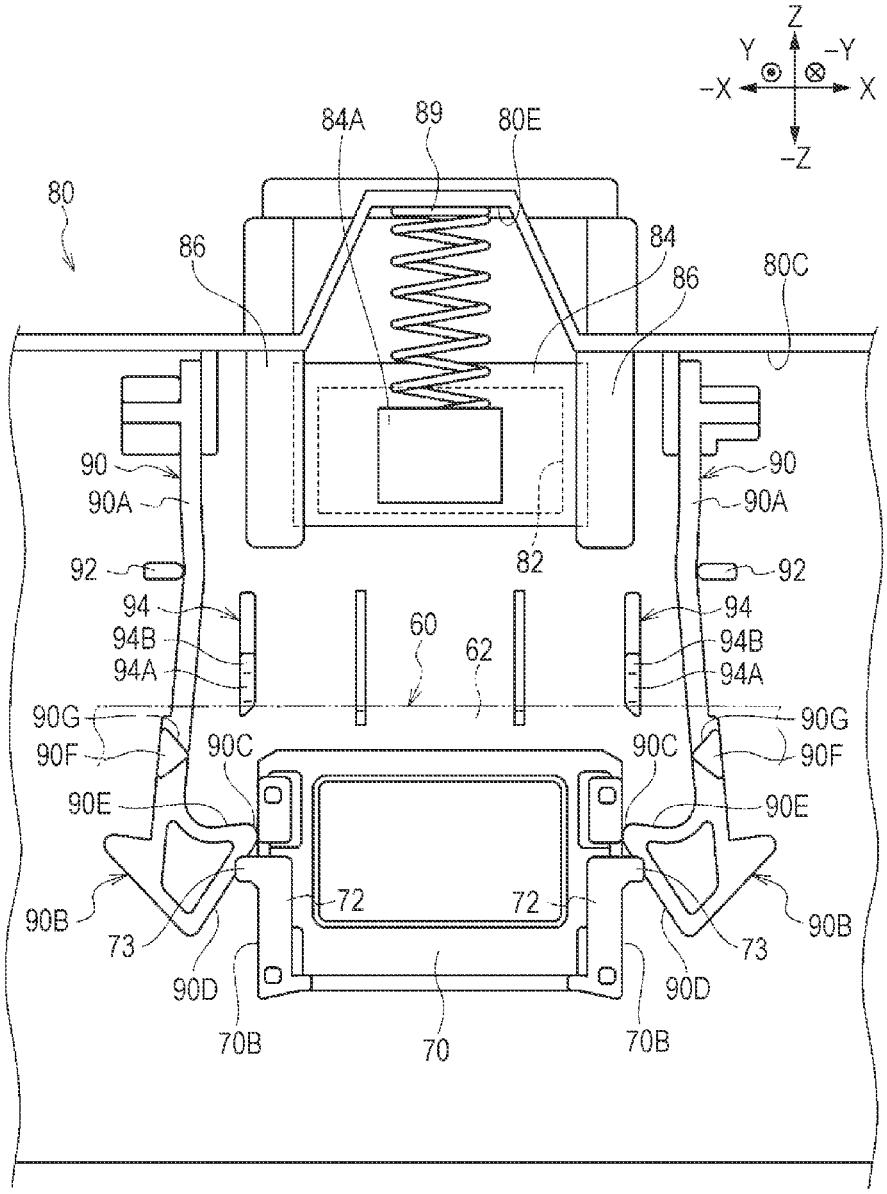
FIG. 10 illustrates how the developer container according to the exemplary embodiment is attached to the mounting.

As the developer container 60 is further moved relative to the mounting 80 in the attachment direction (Z direction), as shown in FIG. 10, the shutter 70 passes between the protrusions 90C of the pair of limiting portions 90, with the protrusions 90C in contact with the sides 70B of the shutter 70. The protruding portions 73 of the shutter 70 then pass over the leading ends 90B of the limiting portions 90.

Figure 11:
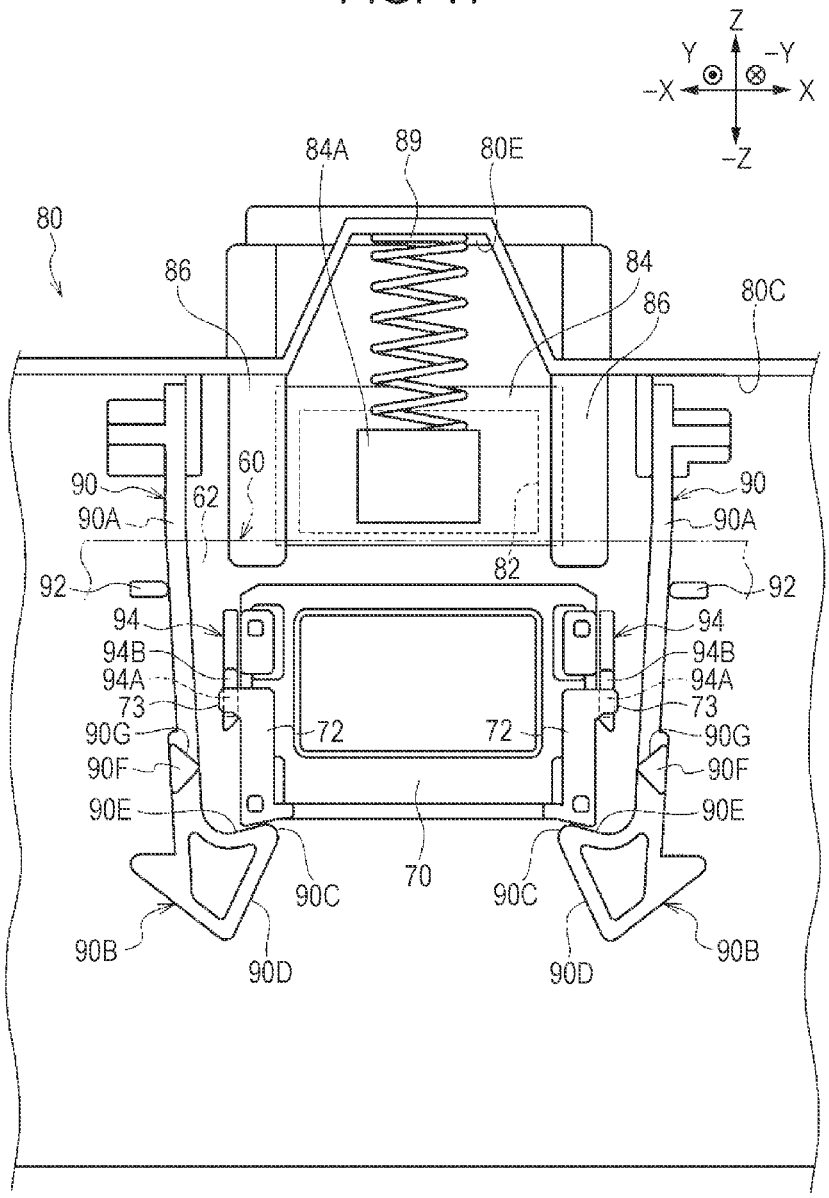
FIG. 11 illustrates how the developer container according to the exemplary embodiment is attached to the mounting.
Figure 12:
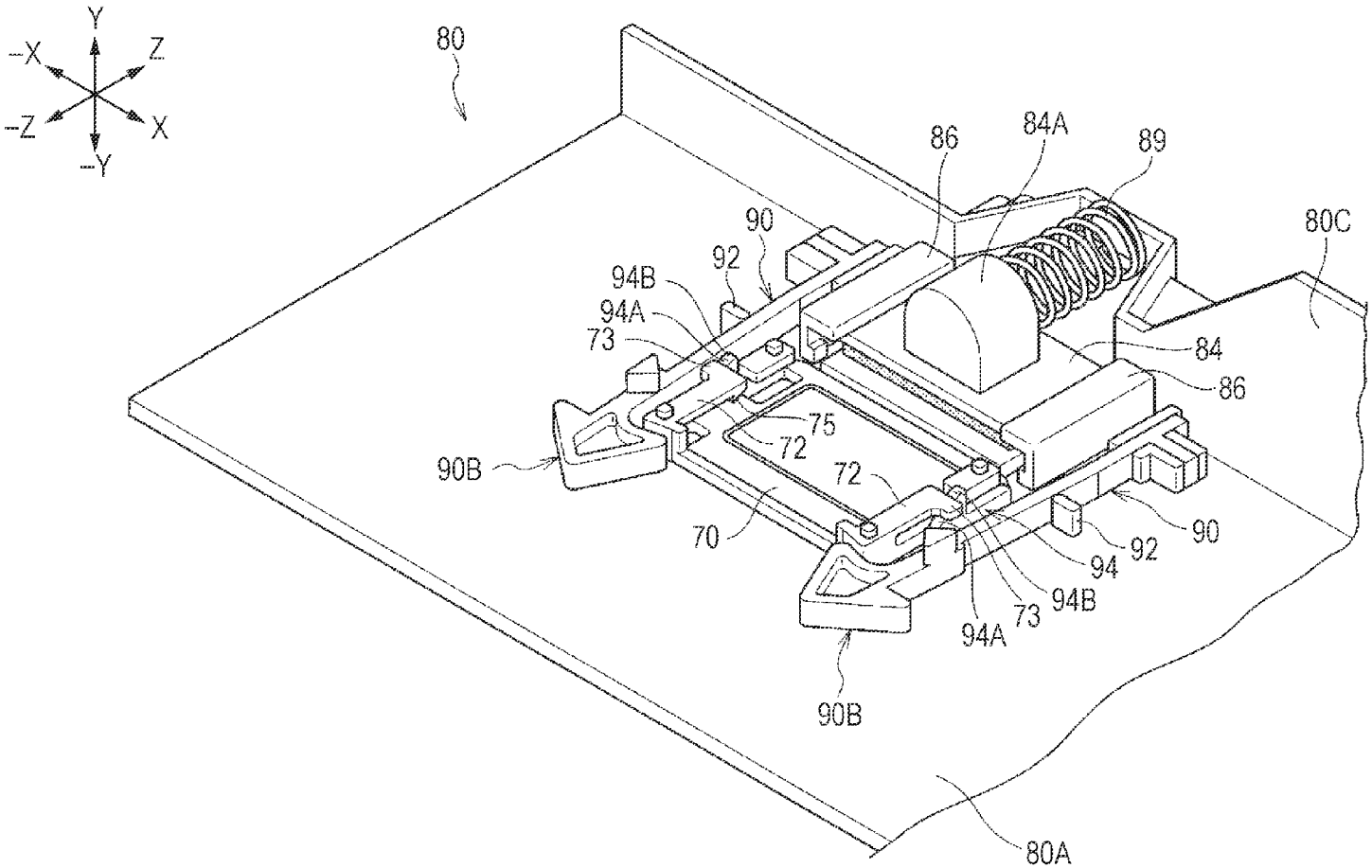
FIG. 12 illustrates how the developer container according to the exemplary embodiment is attached to the mounting.

As the developer container 60 is further moved relative to the mounting 80 in the attachment direction (Z direction), as shown in FIGS. 11 and 12, the shutter 70 finishes passing between the protrusions 90C of the pair of limiting portions 90. The limiting portions 90 then return to their original positions by their elastic force, and the distance between the protrusions 90C of the pair of limiting portions 90 becomes smaller than the width of the shutter 70 in the X direction side.

Figure 13:
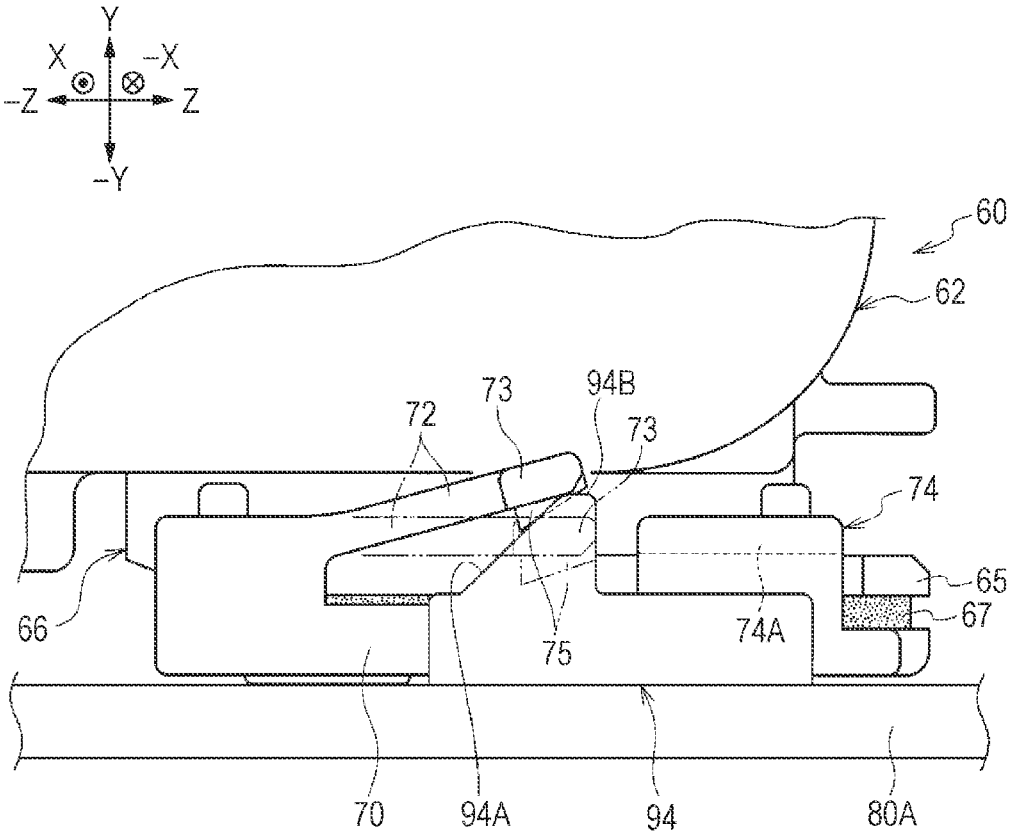
FIG. 13 illustrates how the developer container according to the exemplary embodiment is attached to the mounting.

As shown in FIGS. 12 and 13, the protruding portions 73 of the shutter 70 pass across the lifting surfaces 94A of the release portions 94 in the Z direction while being lifted along the lifting surfaces 94A in the Y direction to elastically deform the support portions 72 in the Y direction, thus allowing the pair of latch portions 75 to come out of the cutouts 65A. As a result, the pair of latch portions 75 are released, permitting the movement of the shutter 70 relative to the developer container 60.

Figure 14:
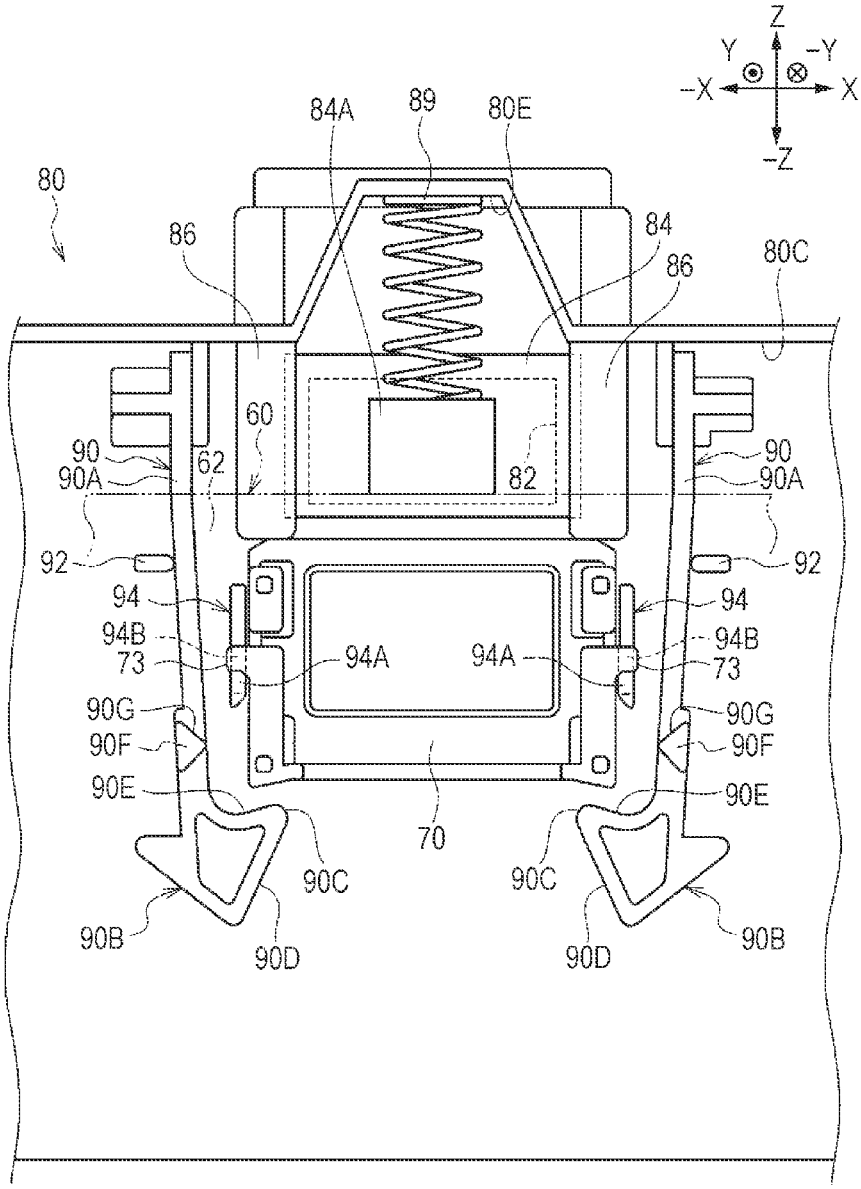
FIG. 14 illustrates how the developer container according to the exemplary embodiment is attached to the mounting.

As the developer container 60 is further moved relative to the mounting 80 in the attachment direction (Z direction), as shown in FIG. 14, the protruding portions 73 are moved onto the top surfaces 94B of the release portions 94, maintaining the latch portions 75 in a released state. In this state, the shutter 70 abuts against the ends of the support portions 86 on the −Z direction side, which restrain the shutter 70 from being moved relative to the mounting 80 in the Z direction and permit only the developer container 60 to be moved relative to the mounting 80 in the Z direction.

Figure 15:
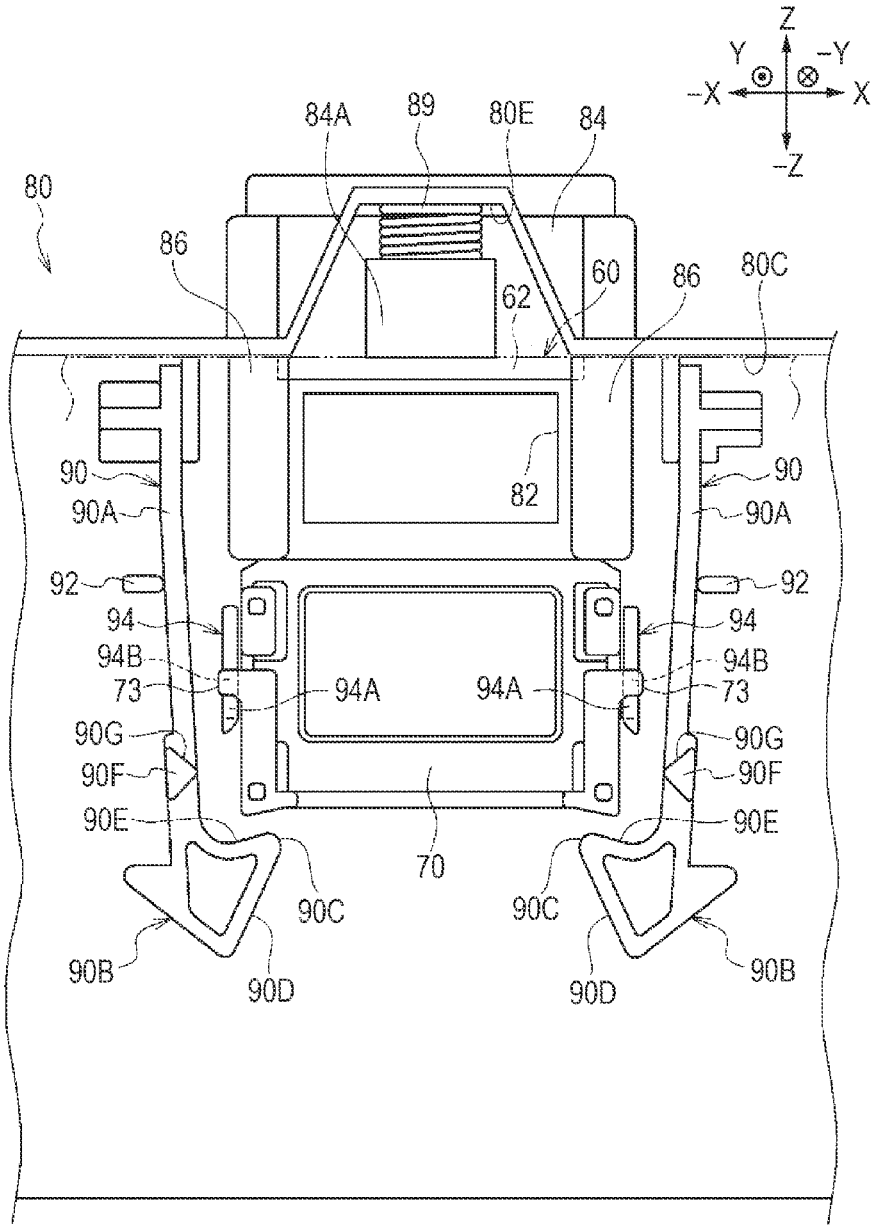
FIG. 15 illustrates how the developer container according to the exemplary embodiment is attached to the mounting.

As the developer container 60 is further moved relative to the mounting 80 in the attachment direction (Z direction), as shown in FIG. 15, the shutter 70 is relatively moved to the open position for opening the opening 64 (see FIG. 6), and the end of the support 66 (see FIG. 4) of the developer container 60 on the Z direction side pushes the end of the opening and closing portion 84 on the −Z direction side in the Z direction against the biasing force of the compression spring 89 to move the opening and closing portion 84 to the open position for opening the inlet 82. As a result, the inlet 82 of the mounting 80 and the opening 64 of the developer container 60, both being open, are located opposite each other, allowing the developer discharged from the opening 64 of the developer container 60 to flow into the inlet 82 of the mounting 80. Thus, the attachment of the developer container 60 to the mounting 80 is completed.

In this state, even if the shutter 70 is moved in the −Z direction, it abuts against the inclined surfaces 90E of the limiting portions 90, which prevent it from being moved beyond the open position to the side facing away from the closed position (in the −Z direction). Thus, the shutter 70 does not come off the support portions 65.

Figure 16:
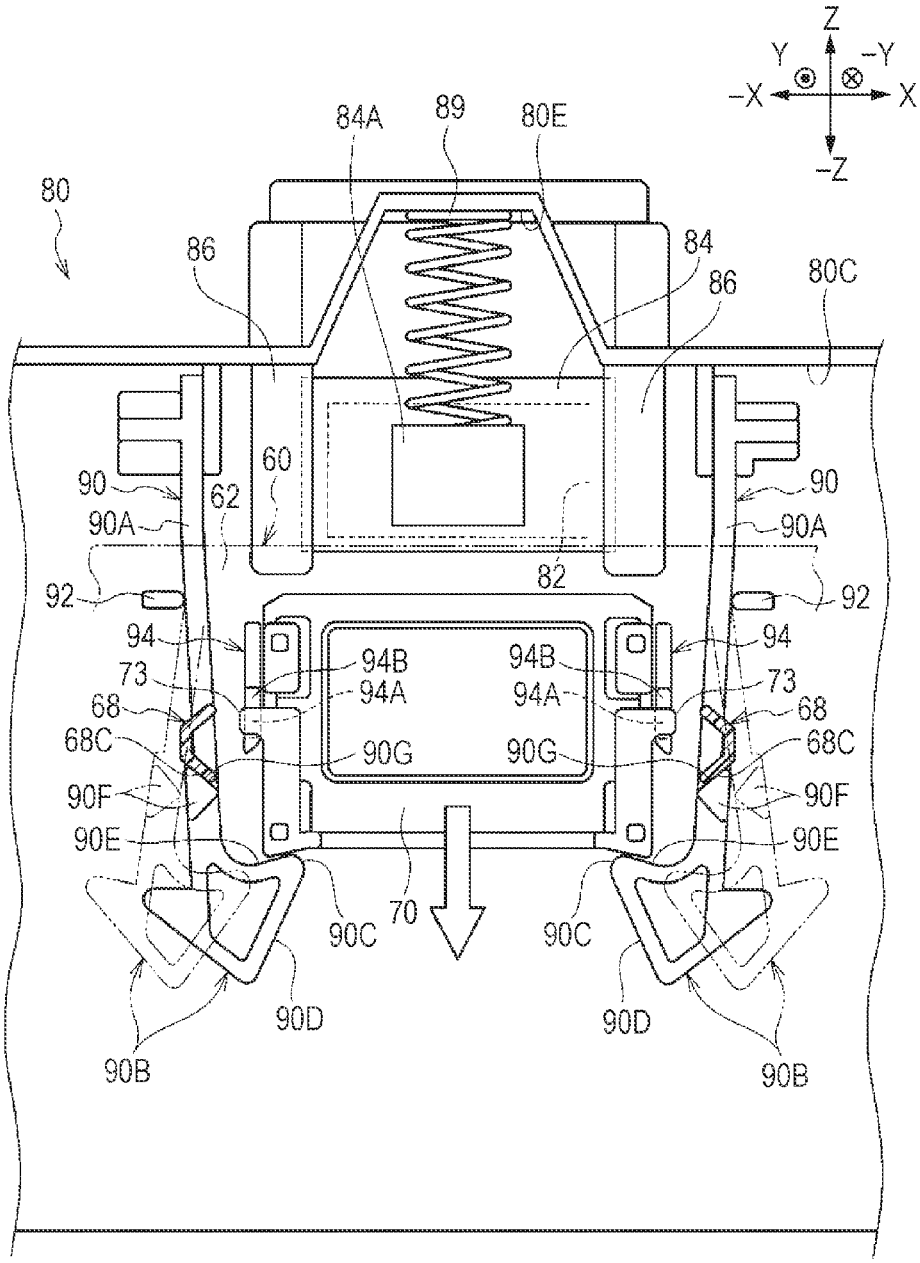
FIG. 16 illustrates how the developer container according to the exemplary embodiment is detached from the mounting.

Upon starting of the detachment of the developer container 60 from the mounting 80 in the detachment direction (−Z direction), as shown in FIG. 16, the opening and closing portion 84 is moved toward the closed position by the biasing force of the compression spring 89. The shutter 70 then abuts against the inclined surfaces 90E of the limiting portions 90, which restrain the movement of the shutter 70 in the −Z direction. As a result, the shutter 70 is relatively moved to the closed position for closing the opening 64.

As the developer container 60 is further moved relative to the mounting 80 in the detachment direction (−Z direction), as shown in FIG. 16, the third ribs 68C of the protective portions 68 abut against the inclined surfaces 90G of the triangular portions 90F of the limiting portions 90 to displace the protrusions 90C of the limiting portions 90 outward, thus elastically deforming the limiting portions 90 outward. Accordingly, the limitation on the movement of the shutter 70 by the limiting portions 90 is removed. The protruding portions 73 of the shutter 70 pass across the lifting surfaces 94A of the release portions 94 in the −Z direction while being lowered along the lifting surfaces 94A in the −Y direction. The support portions 72 then return to their original positions by their elastic force, and the pair of latch portions 75 are latched in the cutouts 65A.

The shutter 70 then passes between the protrusions 90C of the pair of limiting portions 90. Thus, the developer container 60 is detached from the mounting 80.

In this exemplary embodiment, the movement of the shutter 70 relative to the developer container 60 is not permitted until each of the pair of latch portions 75 is independently released. Accordingly, the shutter 70 of the developer container 60 is less likely to be accidentally opened than in the case where the movement of the shutter 70 relative to the developer container 60 is permitted even if not each of the pair of latch portions 75 is independently released.

In this exemplary embodiment, additionally, the latch portions 75 are released as they are moved in the direction toward the container body 62. Accordingly, the latch portions 75 are less accessible because of the container body 62, and therefore the shutter 70 of the developer container 60 is less likely to be accidentally opened, than in the case where the latch portions 75 are released as they are moved in a direction other than the direction toward the container body 62.

In addition, because the latch portions 75 are released as they are moved in the direction toward the container body 62, the container body 62 stops the latch portions 75 if they are moved toward the container body 62 so as to bend the support portions 72 more than necessary. This inhibits damage to the support portions 72.

In this exemplary embodiment, additionally, the protective portions 68 make the latch portions 75 of the shutter 70 less accessible in the closed position. Accordingly, the shutter 70 of the developer container 60 is less likely to be accidentally opened.

In this exemplary embodiment, additionally, the latch portions 75 are located at the center of the shutter 70 in the direction in which the shutter 70 is linearly moved. Accordingly, the latch portions 75 are less accessible, and therefore the shutter 70 of the developer container 60 is less likely to be accidentally opened, than in the case where the latch portions 75 are located at an end of the shutter 70 in the direction in which the shutter 70 is linearly moved.

In this exemplary embodiment, additionally, each of the pair of latch portions 75 is released as the developer container 60 is attached to the mounting 80. This eliminates the need for a release procedure in addition to the attachment procedure.

In this exemplary embodiment, additionally, the protective portions 68 push the limiting portions 90 to remove the limitation on the movement of the shutter 70 by the limiting portions 90 as the developer container 60 is detached from the mounting 80. This eliminates the need for a release procedure in addition to the detachment procedure.

The present invention is not limited to the above exemplary embodiment; various modifications, changes, and improvements and combinations thereof are permitted.

For example, the developer container 60 may be a container for containing developer removed from the intermediate transfer belt 24 or the photoreceptor 32, that is, a waste toner container for containing waste toner.

In addition, the direction in which the shutter 70 is opened and closed may be the same as or different from the direction in which the developer container 60 is attached to and detached from the mounting 80. The shutter 70 may be provided on a curved surface of the container body 62 and may be curved along the curved surface and be movable along the curved surface.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer container comprising:

a container body having an inner space capable of containing a developer and an opening communicating with the inner space;

an opening and closing portion that is disposed on the container body and that opens and closes the opening; and a pair of restraining portions that are disposed on the opening and closing portion and that each restrain the opening and closing portion from being moved from a closed position to an open position, the opening and closing portion being permitted to be moved to the open position if the restraint on the movement of the opening and closing portion by each of the pair of restraining portions is independently removed.

2. The developer container according to claim 1, wherein the restraint on the movement of the opening and closing portion by the pair of restraining portions is removed as the pair of restraining portions are moved in a direction toward the container body and different from a direction in which the opening and closing portion is opened and closed.

3. The developer container according to claim 1, further comprising protective portions that are disposed on the container body and that protect the restraining portions when the opening and closing portion is in the closed position.

4. The developer container according to claim 2, further comprising protective portions that are disposed on the container body and that protect the restraining portions when the opening and closing portion is in the closed position.

5. The developer container according to claim 1, wherein the opening and closing portion is linearly moved along a surface of the container body to open and close the opening, the restraining portions being located at the center of the opening and closing portion in a direction in which the opening and closing portion is linearly moved.

6. The developer container according to claim 2, wherein the opening and closing portion is linearly moved along a surface of the container body to open and close the opening, the restraining portions being located at the center of the opening and closing portion in a direction in which the opening and closing portion is linearly moved.

7. The developer container according to claim 3, wherein the opening and closing portion is linearly moved along a surface of the container body to open and close the opening, the restraining portions being located at the center of the opening and closing portion in a direction in which the opening and closing portion is linearly moved.

8. The developer container according to claim 4, wherein the opening and closing portion is linearly moved along a surface of the container body to open and close the opening, the restraining portions being located at the center of the opening and closing portion in a direction in which the opening and closing portion is linearly moved.

9. An image-forming apparatus comprising:

the developer container according to claim 1;

a mounting to which the developer container is attached; and a pair of release portions that are disposed on the mounting and that independently release the pair of restraining portions as the developer container is attached.

10. The image-forming apparatus according to claim 9, further comprising limiting portions that, with the developer container attached to the mounting, limit the movement of the opening and closing portion moved to the open position beyond the open position to a side facing away from the closed position, the developer container further including protective portions that are disposed on the container body and that protect the restraining portions when the opening and closing portion is in the closed position, the protective portions pushing the limiting portions to remove the limitation on the movement of the opening and closing portion by the limiting portions as the developer container is moved in a direction in which the developer container is detached from the mounting.

* * * * *